US011596238B2

(12) United States Patent
Huang et al.

(10) Patent No.: US 11,596,238 B2
(45) Date of Patent: Mar. 7, 2023

(54) WRAPAROUND INFLATABLE HEADBOARD APPARATUS AND INFLATABLE BED SYSTEM

(71) Applicant: BESTWAY INFLATABLES & MATERIAL CORP., Shanghai (CN)

(72) Inventors: Shuiyong Huang, Shanghai (CN); Bingrong Wu, Shanghai (CN); Zhikuan Wu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 13 days.

(21) Appl. No.: 16/965,005

(22) PCT Filed: Jan. 31, 2018

(86) PCT No.: PCT/CN2018/074779
§ 371 (c)(1),
(2) Date: Jul. 26, 2020

(87) PCT Pub. No.: WO2019/148382
PCT Pub. Date: Aug. 8, 2019

(65) Prior Publication Data
US 2021/0052080 A1 Feb. 25, 2021

(51) Int. Cl.
*A47C 19/02* (2006.01)
*A47C 19/00* (2006.01)
*A47C 21/00* (2006.01)

(52) U.S. Cl.
CPC ..... *A47C 19/022* (2013.01); *A47C 19/005* (2013.01); *A47C 21/003* (2013.01)

(58) Field of Classification Search
CPC ... A47C 19/022; A47C 19/005; A47C 27/081; A47C 27/10; A47C 21/003; A47C 21/00;
(Continued)

(56) References Cited

U.S. PATENT DOCUMENTS 2,150,434 A * 3/1939 Finlay ..... A47C 27/081 297/452.41
3,419,309 A * 12/1968 Smith ..... A47C 4/52 5/98.1

(Continued)

FOREIGN PATENT DOCUMENTS

CN 2889020 4/2007
CN 2922636 7/2007

(Continued)

OTHER PUBLICATIONS

Extended European Search Report dated Aug. 18, 2021 (Aug. 18, 2021) issued on related European Patent Application 18903366.5 by the European Patent Office.

(Continued)

*Primary Examiner* — David R Hare
*Assistant Examiner* — Alison N Labarge
(74) *Attorney, Agent, or Firm* — Dickinson Wright PLLC

(57) ABSTRACT

A wraparound inflatable headboard apparatus (100) includes a headboard portion (104), first and second arms (106, 108), and a plurality of accessories (138, 140,142, 144, 148), wherein the headboard portion (104) and the first and second arms (106, 108) are configured to accommodate plurality of accessories (138, 140,142, 144, 148), at least one of which is fixedly attached to the at least one of the headboard portion (104), the first arm (106), and the second arm (108), and at least one of which is removable from the at least one of the headboard portion (104), the first arm (106), and the second arm (108). An inflatable bed system (122) includes an inflatable headboard apparatus (100) comprised of a headboard (104), arms (106, 108), an inflatable mattress (102), and at least one accessory (138, 140,142, 144, 148), wherein the headboard (104) and arms (106, 108) are configured in a bracket shape, the inflatable mattress (102) comprises a shape complementary to the bracket shape of
(Continued)

the headboard (104) and arms (106, 108) such that the inflatable headboard apparatus (100) at least partially surrounds the inflatable mattress (102), and the at least one accessory (138, 140,142, 144, 148) is supplied proximal to a user when the inflatable headboard apparatus (100) is arranged about the inflatable mattress (102).

18 Claims, 2 Drawing Sheets

(58) Field of Classification Search
CPC .... A47C 4/54; A47C 7/42; A47C 7/40; A47G 7/0506
See application file for complete search history.

(56) References Cited

U.S. PATENT DOCUMENTS

| | | | | |
|---|---|---|---|---|
| 3,420,574 | A * | 1/1969 | Smith | A47C 4/54 297/DIG. 8 |
| 7,555,797 | B1 * | 7/2009 | Wu | A47C 27/081 5/710 |
| 8,136,182 | B2 * | 3/2012 | Ellis | A47C 17/80 5/118 |
| 9,144,318 | B1 * | 9/2015 | Lagier | A47C 3/16 |
| D880,197 | S * | 4/2020 | D'Amico | D6/604 |
| 2001/0052153 | A1 * | 12/2001 | Schwartz | A47C 7/725 5/905 |
| 2005/0099054 | A1 * | 5/2005 | McCarthy | A47C 17/045 297/452.41 |
| 2006/0163935 | A1 * | 7/2006 | Harris | A47C 17/045 297/452.41 |
| 2007/0061977 | A1 * | 3/2007 | Zheng | A47C 4/54 5/655.3 |
| 2007/0169273 | A1 * | 7/2007 | Wu | A47C 27/081 5/710 |
| 2007/0199153 | A1 * | 8/2007 | Wu | A47C 27/081 5/706 |
| 2007/0283500 | A1 * | 12/2007 | Chang | A47C 27/10 5/713 |
| 2009/0019638 | A1 | 1/2009 | Ellis | |
| 2010/0231009 | A1 | 9/2010 | Chi | |
| 2014/0130252 | A1 * | 5/2014 | Carlin | A47B 83/045 5/2.1 |
| 2015/0196443 | A1 * | 7/2015 | Tarquinio | A47C 21/00 5/613 |
| 2016/0242564 | A1 * | 8/2016 | Cass | A47C 21/00 |
| 2017/0149181 | A1 * | 5/2017 | Nelson | A47C 21/003 |
| 2019/0038024 | A1 * | 2/2019 | Coons | A47B 81/005 |

FOREIGN PATENT DOCUMENTS

| | | | |
|---|---|---|---|
| CN | 201019308 | 2/2008 | |
| CN | 201101294 | 8/2008 | |
| CN | 103939732 | 7/2014 | |
| CN | 104473498 | 4/2015 | |
| CN | 106343807 | 1/2017 | |
| DE | 202015101276 U1 * | 7/2015 | A47C 19/02 |
| GB | 2375294 A * | 11/2002 | A47C 20/027 |

OTHER PUBLICATIONS

First Office Action dated Oct. 28, 2021 (Oct. 28, 2021) issued on related Chinese patent application 201880087161.5 by The State Intellectual Property Office of People's Republic of China.

* cited by examiner

WRAPAROUND INFLATABLE HEADBOARD APPARATUS AND INFLATABLE BED SYSTEM

CROSS-REFERENCE TO RELATED APPLICATION

This application is a 35 U.S.C. § 371 national stage application which claims the benefit and priority of PCT Application Ser. No. PCT/CN2018/074779, filed on Jan. 31, 2018, which is hereby incorporated herein by reference in its entirety.

TECHNICAL FIELD

The present subject matter relates to inflatable beds, and more particularly, to headboards and accessories for inflatable beds.

BACKGROUND

Often times, inflatable mattresses have significant utility and are capable of storage, transportation, and use in a variety of settings and environments. Accessories that improve the comfort and satisfaction of the user experience for inflatable mattresses represent an improvement in the art. However, given the current state of the art, inflatable mattresses may benefit from improvements in structural stability. Further, a user may find it difficult to use an inflatable mattress with a number of other amenities to which said user may be accustomed. For example, it may be difficult for a user to read a book while using an inflatable mattress.

To solve this challenge, the below disclosure sets forth an inflatable headboard apparatus that supplies additional accessories and/or amenities. Still further, the apparatus contemplated herein imparts additional advantages, including increased stability, to a traditional inflatable mattress.

The description provided in the background section should not be assumed to be prior art merely because it is mentioned in or associated with the background section. The background section may include information that describes one or more aspects of the subject technology.

SUMMARY

According to an aspect of the present disclosure, a wraparound inflatable headboard apparatus includes a headboard portion, first and second arms, and a plurality of accessories. Further according to this aspect, the headboard portion and the first and second arms are configured to accommodate the plurality of accessories, at least one of which is fixedly attached to the at least one of the headboard portion, the first arm, and the second arm, and at least one of which is removable from the at least one of the headboard portion, the first arm, and the second arm.

According to another aspect of the present disclosure, an inflatable bed system includes an inflatable headboard apparatus having a headboard and arms, an inflatable mattress, and at least one accessory. Further in accordance with this system, the headboard and arms are configured in a bracket shape, the inflatable mattress has a shape complementary to the bracket shape of the headboard and arms such that the inflatable headboard apparatus at least partially surrounds the inflatable mattress, and the at least one accessory is supplied proximal a user when the inflatable headboard apparatus is arranged about the inflatable mattress.

Other aspects and advantages of the present invention will become apparent upon consideration of the following detailed description and the attached drawings wherein like numerals designate like structures throughout the specification.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Still further, modules and components depicted may be combined, in whole or in part, and/or divided, into one or more different parts, as applicable to fit particular implementations without departing from the scope of the present disclosure. Accordingly, the drawings and description are to be regarded as illustrative in nature and not restrictive.

Figure 1:
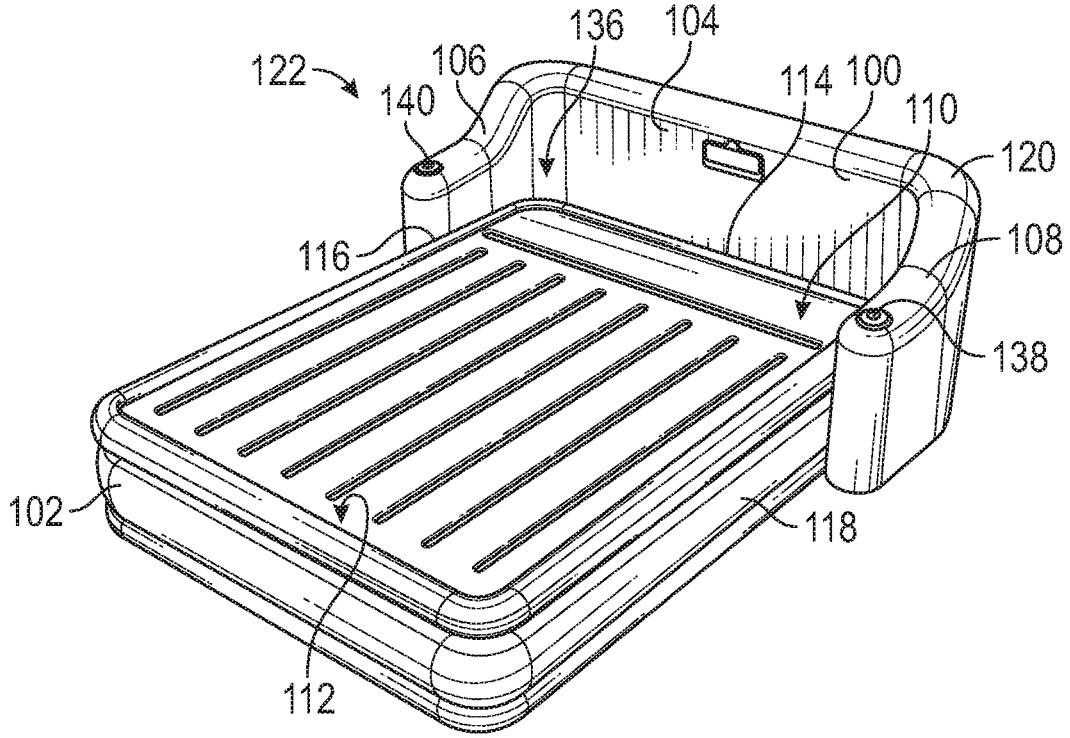
FIG. 1 is a front isometric view of an inflatable mattress with an example embodiment of an inflatable wraparound headboard apparatus according to aspects of this disclosure.

Referring now to FIG. 1, a wraparound inflatable headboard apparatus 100 is illustrated coupled with and around an inflatable mattress 102. The wraparound inflatable headboard apparatus 100 comprises a headboard/support portion 104 and first and second arms 106, 108. The wraparound inflatable headboard apparatus 100 partially surrounds a first, head end 110 of the inflatable mattress 102 disposed opposite a second, foot end 112 of the inflatable mattress 102. The headboard/support portion 104 of the wraparound inflatable headboard apparatus 100 abuts a head end sidewall 114 of the inflatable mattress 102. The first and second arms 106, 108 abut respective first and second sidewalls 116, 118 of the inflatable mattress 102.

The first and second arms 106, 108 and the headboard/support portion 104 share an upper surface 120. The upper surface 120 may have a bracket-shaped or generally U-shaped outline from a plan view thereof, and said upper surface 120 may form a continuous upper surface for the wraparound inflatable headboard apparatus 100. The upper surface 120 may be further rounded so as to provide a surface comfortable for resting a head or arm of one or more users thereon. The upper surface 120, and more generally a side elevational profile (from a left and/or a right side) of the wraparound inflatable headboard apparatus 100, slopes downwardly from the headboard/support portion 104 to the first and second arms 106 and 108 whereat said first and second arms 106, 108 meet the headboard/support portion 104. In this example embodiment, the headboard/support portion 104 has an elevation above the first and second arms 106, 108. As the first and second arms 106, 108 extend away from the headboard/support portion 104; the upper surface 120 thereof flattens to provide an armrest portion of the first and second arms 106, 108. The headboard/support portion 104 may further provide a back rest/support for the one or more users that may assume a seated position on the mattress portion 102 with the back of the user(s) resting against the headboard/support portion 104. The headboard/support portion 104 may flex/bend under pressure applied by the back of the one or more users thereby facilitating a comfortable incline for the user(s). The head end sidewall 114 of the inflatable mattress 102 may be coupled with the headboard/support portion 104 by one or more semi-permanent connections such as high-frequency welds, PVC tapes, and/or sonic welding of PVC. In further example embodiments, the head end sidewall 114 of the inflatable mattress 102 is coupled with the headboard/support portion 104 by hooks, buckle straps, hook and loop fasteners (Velcro®), and/or another suitable coupling mechanism. The first and second arms 106, 108 of the headboard/support portion 104 may be similarly coupled to the respective first and second sidewalls 116, 118 of the inflatable mattress 102. In example embodiments, the first and second arms 106, 108 may be high-frequency welded to the headboard/support portion 104.

A structural body of the wraparound inflatable headboard apparatus 100, as described herein above, is disposed at least partially about the head end 110 of the inflatable mattress 102. Such a configuration may provide additional support to the inflatable mattress 102 and increase the stability of the combined bed system 122 comprising the wraparound inflatable headboard apparatus 100 and the inflatable mattress 102. Stability may be increased by the abutment of the headboard/support portion 104 adjacent to the head end sidewall 114 and/or the attachment thereto. Further, stability may be increased by the abutment and/or attachment (described hereinbelow) of the first and second arms 106, 108 adjacent to the respective first and second sidewalls 116, 118 of the inflatable mattress. Still further, the combination of the portions of the wraparound inflatable headboard apparatus 100 abutting the sidewalls 114, 116, 118 of the inflatable mattress 102 may also increase stability of the inflatable mattress 102 and the combined bed system 122. The wraparound inflatable headboard apparatus 100, by virtue of the construction and molding thereof, provides shape and structural integrity to the combined bed system 122.

Figure 2:
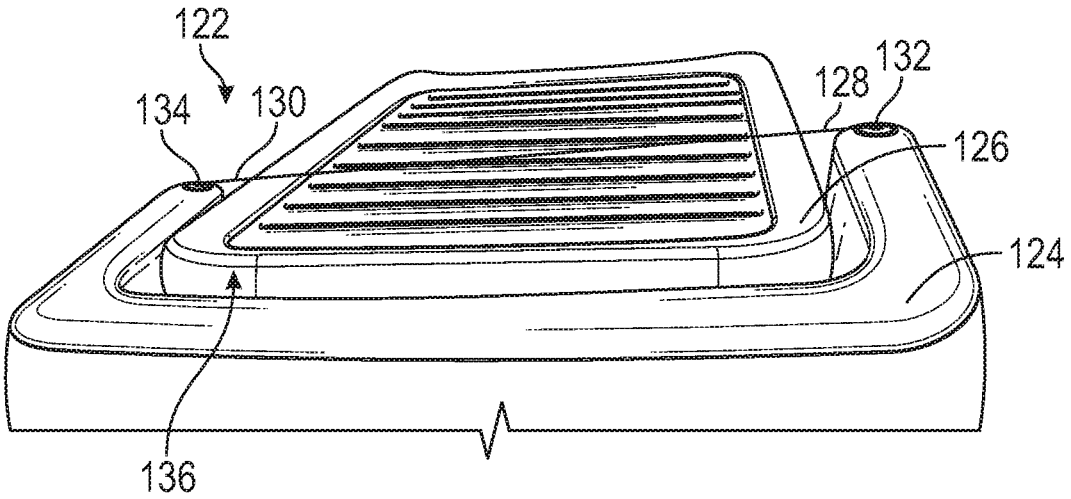
FIG. 2 is an inverted, isometric view from below of the inflatable mattress and wraparound headboard apparatus of FIG. 1.

Referring now to FIG. 2, a first bottom surface 124 of the wraparound inflatable headboard apparatus 100 and a second bottom surface 126 of the inflatable mattress 102 are illustrated as substantially aligned. The bottom surfaces 124, 126 may be aligned flush with one another, or both surfaces 124, 126 may be disposed on a ground/floor surface upon which the combined bed system 122 is placed. The bottom surface 124 of the wraparound inflatable headboard apparatus 100 forms a continuous bottom surface of the headboard/support portion 104 and the first and second arms 106, 108. A coupling component 128 is disposed along the first and second bottom surfaces 124, 126 to couple together the wraparound inflatable headboard apparatus 100 and the inflatable mattress 102. In the example embodiment of FIG. 2, the coupling component 128 comprises a strap 130 extending between the first and second arms 106, 108 of the wraparound inflatable headboard apparatus 102. The strap 130 may have first and second connecting points 132, 134 disposed on the bottom surface 124 of the wraparound inflatable headboard apparatus 100 beneath first and second arms 106, 108.

As discussed hereinabove, the head end 110 of the inflatable mattress 102 is at least partially surrounded by the wraparound inflatable headboard apparatus 100. The bracket or U-shape of the wraparound inflatable headboard apparatus 100 forms a space 136 bounded by the headboard/support portion 104 and the first and second arms 106, 108 into which the head end 110 of the inflatable mattress 102 fits, i.e., the inflatable mattress 102 is nested within a combination of the headboard/support portion 104 and the first and second arms 106, 108. As depicted in FIG. 2, the strap 130 traverses the space 136 formed by the wraparound inflatable headboard apparatus 100. The strap 136 may contact the bottom surface 126 of the inflatable mattress 102 when same is positioned within the space 136 of the wraparound inflatable headboard apparatus 100. By abutting an additional surface of the inflatable mattress 102, specifically the bottom surface 126 thereof, the coupling component 128 increases the stability and supportiveness of a coupling connection between the wraparound inflatable headboard apparatus 100 and the inflatable mattress 102. Increasing the stability and supportiveness of the connection between the wraparound inflatable headboard apparatus 100 and the inflatable mattress 102 may further increase the stability and cohesiveness of the combined bed system 122. The strap 136 and/or the shape/structure of the wraparound inflatable headboard apparatus 100 may aid in preventing tilt of the inflatable mattress 102, such as tilt during use on only on side thereof or when a user exits the combined bed system while disproportionately shifting weight and pressure to one or more sides of the inflatable mattress 102.

The strap 130 illustrated in FIG. 2, may be comprised of canvas, fabric, PVC, plastic, elastic, and/or another suitable materials for forming the strap and holding the inflatable mattress 102 in place relative the wraparound inflatable headboard apparatus 100. The strap 130 may also aid and maintain alignment of the wraparound inflatable headboard apparatus 100 relative the head end 110 of the inflatable mattress 102 during use of the combined bed system 122. Further, the combination of the bracket/U-shape of the wraparound inflatable headboard apparatus 100 and the coupling component 128 may aid and maintain alignment of the wraparound inflatable headboard apparatus 100 during use of the combined bed system 122. In an example embodiment, complementary strips of hook and loop fastener (such as Velcro®) may replace and/or supplement the coupling component 128.

The strap 130 may be flexibly attached to the first and second connecting points 132, 134 on the underside 124 of the wraparound inflatable headboard apparatus 100. The flexible attachment of the strap 130 to these first and second connecting points 132, 134 may be provided by tying the straps to anchoring pieces in the first and second connecting points 132, 134 or by fabricating the first and second connecting points 132, 134 in such a manner as to hold and encompass respective ends of the strap 130. The strap 130 may be welded (such as with heat and/or PVC tapes) to the bottom side 124 of the wraparound inflatable headboard apparatus 100. In an example embodiment, the strap 130 may be clipped to the first and second connecting points 132, 134 by one or more plastic clips. Further, in example embodiments, the coupling component 128 may instead be formed from first and second straps joined by a clip somewhere along the length of the coupling component 128. Still further, in example embodiments, the strap 130 or straps may be retractable at the first and second connecting points 132, 134 and/or spring loaded. The strap 130 or straps may be stored within the first and second arms 106, 108 at the first and second connecting points 132, 134.

Figure 3:
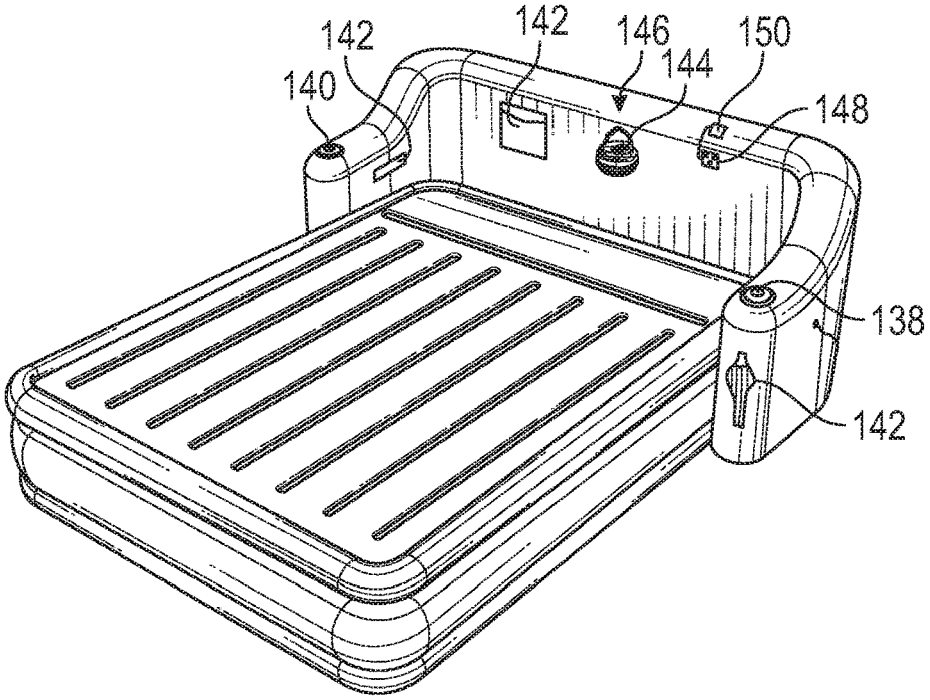
FIG. 3 is another example embodiment of an inflatable wraparound headboard apparatus according to aspects of this disclosure and including a removable lantern accessory.

Referring now to FIG. 3, an example embodiment of the wraparound inflatable headboard apparatus 100 is illustrated with accessories disposed thereon. The first and second arms 106, 108 may have positioned through the upper surface 120, and extending into the interior/inflation compartment of the wraparound inflatable headboard apparatus 100, respective first and second cupholders 138, 140. Considering that the first and second cup holders 138, 140 may be of substantially identical construction (although perhaps mirrored for disposition on either a left or right side) only the first cupholder 138 is described herein below. The cupholder 138 may be manufactured from plastic, fabric, PVC, netting, and/or another suitable material for holding an object, such as a drink container, within the arm 106 of the wraparound inflatable headboard apparatus 100. The cupholder 138 may be formed from rigid plastic, still further aiding the structural stability of the arm 106. In example embodiments, the cupholder 138 may instead comprise a sleeve formed from the material similar to the arm and/or wraparound inflatable headboard apparatus 106/100. Such a sleeve construction may be employed to form additional accessories within the wraparound inflatable headboard apparatus 100.

In example embodiments, one or more slots and/or sleeves 142 may be disposed within the wraparound headboard inflatable apparatus 100 for storing and/or displaying a smartphone, tablet, another mobile device, and/or any other object of suitable size that the user may desire to place therein. Example embodiments include a shelf disposed within at least one of the first and second arms 106, 108 for holding cups, glasses, or the like. Further according to example embodiments, the first and/or second arms 106, 108 may be shaped as one or more nightstands. Additional accessories may be included therein such as a garbage receptacle. The accessories may be fixedly attached to the wraparound inflatable headboard apparatus 100, integrated into a structure of the wraparound inflatable headboard apparatus 100 (e.g., the garbage receptacle, cupholder(s) 138, and/or other accessories), and/or removable from the wraparound inflatable headboard apparatus 100. Further, the one or more slots and/or sleeves 142 may be convertible and/or interchangeable between one or more of the accessory features described herein.

Figure 4:
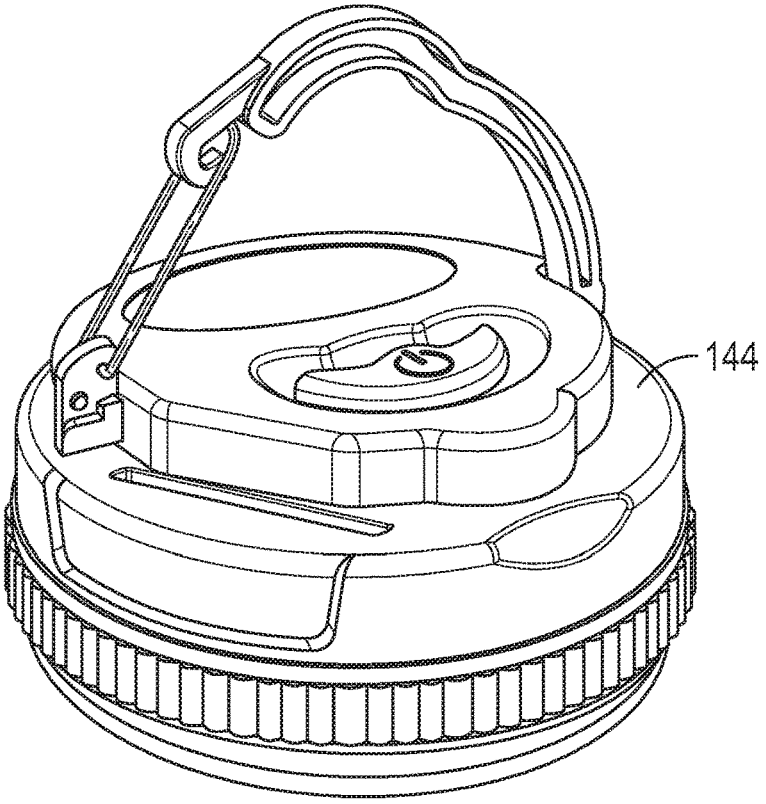
FIG. 4 is an enlarged, isometric view of a lantern accessory for use with the inflatable wraparound headboard apparatus of FIG. 3.

Further accessories may be combinable with the wraparound inflatable headboard apparatus 100, such as a lantern 144 as shown in FIG. 4. Referring once again to FIG. 3, the lantern 144 may be disposed within a slot 146 or another suitable compartment formed on, or in, the wraparound inflatable headboard apparatus 100. The lantern 144 may clip, lock, and/or hook within the slot 146, as appropriate and suitable for securement thereto. The lantern 144 may further be removable from the slot, for use as a flashlight, such that the user may carry the lantern 144 away from the combined bed system 122 or focus the light provided by the lantern 144 upon a desired subject. In example embodiments, the lantern 144 may hang from a flap or hook extendable out and away from the headboard/support portion 104 or from the first and second arms 106, 108. Still further in example embodiments, the lantern 144 may be connectable to a power component 148, such as an outlet, battery, solar panel 150, etc., disposed within the headboard/support portion 104. Additionally, the power component 148 may be disposed at another location on the wraparound inflatable headboard apparatus 100 apart from the lantern 144 so as to provide easily accessible power to the user. In further example embodiments, the lantern 144 may be coupled to the wraparound inflatable headboard apparatus 100 by one or more magnets disposed within the lantern 144, the wraparound inflatable headboard apparatus 100, or both.

The embodiment(s) detailed hereinabove may be combined in full or in part, with any alternative embodiment(s) described.

INDUSTRIAL APPLICABILITY

The above disclosure may represent an improvement in the art because it allows for use of an inflatable wraparound headboard apparatus with inflatable mattresses. Further, this disclosure provides the user with improved stability and increased incorporation of accessories. Still further, the disclosure improves the art by supplying an alternative construction for an inflatable headboard.

It is to be understood that all described elements and features in this disclosure can be formed of any number of materials including, but not limited to, polymers, rubbers, foams, ceramics, metals, metal alloys or any other material known to those skilled in the art. In particular, the material forming the wraparound inflatable headboard apparatus 100 and/or the inflatable mattress 102 may be plastic, vinyl, coated fabric, and/or another suitable material or combination of materials. Valve(s) disposed on these components may be formed from extruded plastic, machined aluminum, another metal alloy, and/or another materials or combination of materials suitable for manufacturing valve(s) for inflatables.

While some implementations have been illustrated and described, numerous modifications come to mind without significantly departing from the spirit of the disclosure; and the scope of protection is only limited by the scope of the accompanying claims.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

In one aspect, a term coupled or the like may refer to being directly coupled. In another aspect, a term coupled or the like may refer to being indirectly coupled. Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The use of the terms "a" and "an" and "the" and "said" and similar references in the context of describing the invention (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. A wraparound inflatable headboard apparatus, comprising:

a headboard portion;

a first inflatable and a second inflatable arm;

a plurality of accessories; and a coupling component configured to couple the inflatable headboard apparatus with an inflatable mattress, the coupling component comprising a strap extending from a first connecting point disposed on a bottom surface of the first inflatable arm, under the inflatable mattress, and to a second connecting point disposed on a bottom surface of the second inflatable arm;

wherein the headboard portion, the first inflatable arm, and the second inflatable arm are configured to accommodate the plurality of accessories;

wherein at least one of the accessories is fixedly attached to at least one of the headboard portion, the first inflatable arm, and the second inflatable arm; and wherein at least one of the accessories is coupled to and removable from at least one of the headboard portion, the first inflatable arm, and the second inflatable arm.

2. The wraparound inflatable headboard apparatus of claim 1, wherein the plurality of accessories comprises at least one of a lantern, a mobile device storage and a cupholder.

3. The wraparound inflatable headboard apparatus of claim 1, wherein one of the plurality of accessories is a holster.

4. The wraparound inflatable headboard apparatus of claim 1, wherein one of the plurality of accessories is powered.

5. The wraparound inflatable headboard apparatus of claim 1, wherein one of the plurality of accessories is an outlet.

6. The wraparound inflatable headboard apparatus of claim 1, wherein one or more of the plurality of accessories is integrated into a structural body of the wraparound inflatable headboard apparatus.

7. The wraparound inflatable headboard apparatus of claim 1, further comprising a first plastic clip connecting the strap to the first connecting point and a second plastic clip connecting the strap to the second connecting point.

8. The wraparound inflatable headboard apparatus of claim 1, wherein the strap comprises a first strap portion connected to the first connecting point, a second strap portion connected to the second connecting point, and a clip connecting the first strap portion to the second strap portion.

9. The wraparound inflatable headboard apparatus of claim 1, further comprising a storage space disposed in one of the first inflatable arm and the second inflatable arm, wherein the strap is retractable into the storage space by means of a spring.

10. An inflatable bed system, comprising:

an inflatable headboard apparatus comprising a headboard, a first inflatable arm, and a second arm;

an inflatable mattress;

a coupling component configured to couple the inflatable headboard apparatus with the inflatable mattress, the coupling component comprising a strap extending from a first connecting point disposed on a bottom surface of the first inflatable arm, under the inflatable mattress, and to a second connecting point disposed on a bottom surface of the second inflatable arm; and at least one accessory;

wherein the headboard, the first inflatable arm, and the second inflatable arm are configured in a bracket shape;

wherein the inflatable mattress comprises a shape complementary to the bracket shape of the headboard, the first inflatable arm, and the second inflatable arm such that the inflatable headboard apparatus at least partially surrounds the inflatable mattress;

wherein the at least one accessory is supplied proximal a user when the inflatable headboard apparatus is arranged about the inflatable mattress; and wherein the at least one accessory is coupled to and removable from at least one of the headboard, the first inflatable arm, and the second inflatable arm.

11. The inflatable bed system of claim 10, wherein the at least one accessory further comprises additional storage.

12. The inflatable bed system of claim 10, wherein the inflatable headboard apparatus is arranged to at least partially surround the inflatable mattress.

13. The inflatable bed system of claim 12, wherein the inflatable headboard apparatus imparts stability to the inflatable mattress by contacting the inflatable mattress on at least three sides thereof.

14. The inflatable bed system of claim 10, wherein the headboard is at least partially elevated above the inflatable arms.

15. The inflatable bed system of claim 14, wherein the headboard and the inflatable arms are at least partially elevated above the inflatable mattress.

16. The inflatable bed system of claim 10, further comprising a first plastic clip connecting the strap to the first connecting point and a second plastic clip connecting the strap to the second connecting point.

17. The inflatable bed system of claim 10, wherein the strap comprises a first strap portion connected to the first connecting point, a second strap portion connected to the second connecting point, and a clip connecting the first strap portion to the second strap portion.

18. The inflatable bed system of claim 10, further comprising a storage space disposed in one of the first inflatable arm and the second inflatable arm, wherein the strap is retractable into the storage space by means of a spring.

* * * * *